US009140133B2

(12) United States Patent
Hagan et al.

(10) Patent No.: US 9,140,133 B2
(45) Date of Patent: Sep. 22, 2015

(54) THREADED FULL RING INNER AIR-SEAL

(75) Inventors: Benjamin F. Hagan, Manchester, CT (US); Joseph T. Caprario, Cromwell, CT (US)

(73) Assignee: United Technologies Corporation, Hartford, CT (US)

( * ) Notice: Subject to any disclaimer, the term of this patent is extended or adjusted under 35 U.S.C. 154(b) by 631 days.

(21) Appl. No.: 13/584,940

(22) Filed: Aug. 14, 2012

(65) Prior Publication Data

US 2014/0050564 A1 Feb. 20, 2014

(51) Int. Cl.
*F01D 11/00* (2006.01)
*F01D 9/06* (2006.01)

(52) U.S. Cl.
CPC ..... *F01D 11/001* (2013.01); *F01D 9/065* (2013.01); *F05D 2240/11* (2013.01)

(58) Field of Classification Search
CPC ..... F01D 9/047; F05D 2240/11; F16J 15/444
USPC ..... 415/173.7
See application file for complete search history.

(56) References Cited

U.S. PATENT DOCUMENTS 3,941,500 A * 3/1976 Glenn ..... 415/136
4,767,267 A * 8/1988 Salt et al. ..... 415/173.7
4,856,963 A 8/1989 Klapproth et al.
5,343,694 A * 9/1994 Toborg et al. ..... 60/796
6,129,512 A 10/2000 Agram et al.
6,413,043 B1 7/2002 Bouyer
7,172,199 B2 2/2007 Rogers
7,458,771 B2 12/2008 Abadie et al.
7,854,586 B2 12/2010 Major et al.
7,857,582 B2 12/2010 Kovac et al.
7,918,643 B2 4/2011 Weaver
8,016,553 B1 9/2011 Liang
2005/0035559 A1 2/2005 Rogers
2009/0238683 A1 9/2009 Alvanos et al.

FOREIGN PATENT DOCUMENTS

EP 2415969 A1 2/2012

OTHER PUBLICATIONS

International Preliminary Report on Patentability for International Application No. PCT/US2013/051584 mailed Feb. 26, 2015.
International Search Report & Written Opinion for International Application No. PCT/US2013/051584 mailed on May 9, 2014.

* cited by examiner

*Primary Examiner* — Edward Look
*Assistant Examiner* — Jason Davis
(74) *Attorney, Agent, or Firm* — Carlson, Gaskey & Olds, P.C.

(57) ABSTRACT

A disclosed vane assembly includes a vane section formed of a plurality of circumferentially spaced fixed vanes. The vanes extend radially outward from an inner platform and hooked into case. The inner platform includes a mount rail extending radially inwardly from the inner platform. An air seal is attached to the inner platform of the vane section and includes a ring extending circumferentially about the axis. The disclosed air seal includes a plurality of tabs that receive lugs disposed on the mount rail. A ring nut is secured to the air seal and engaged to the mount rail for securing the vane section to the air seal.

18 Claims, 6 Drawing Sheets

THREADED FULL RING INNER AIR-SEAL

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

Compressor and turbine sections include stages of rotating airfoils and stationary vanes. Radially inboard and outboard platforms and seals contain gas flow through the airfoils and vanes. Seals between rotating and static parts include edges that ride and abut static honeycomb elements. Moreover, cooling airflow is often directed through the static vanes to inner surfaces to provide an air pressure and/or flow that further contain the flow of hot gases between platforms of the airfoils and vanes. The structures required to define sealing interfaces and cooling air passages can be costly and complicate assembly.

Accordingly, it is desirable to design and develop structures that reduce cost, simplify assembly while containing hot gas flow and defining desired cooling airflow passages.

SUMMARY

A turbine section according to an exemplary embodiment of this disclosure, among other possible things includes first and second turbine rotors each carrying turbine blades for rotation about a central axis. The rotors each have at least one rotating seal at a radially inner location. A vane assembly includes a vane extending radially from a platform. An air seal is attached to the vane assembly, the air seal includes a ring extending circumferentially about the axis and a ring nut received on the air seal for securing the air seal to the vane assembly.

In a further embodiment of the foregoing turbine section, the air seal includes mating features for circumferentially locating the air seal relative to the vane assembly.

In a further embodiment of any of the foregoing turbine sections, includes a full ring seal disposed between a surface of the vane platform and the ring nut.

In a further embodiment of any of the foregoing turbine sections, includes a lock ring engaged to the air seal and the ring nut for securing a relative position between the ring nut and the air seal.

In a further embodiment of any of the foregoing turbine sections, includes a wire seal disposed between the ring nut and a surface of the air seal.

In a further embodiment of any of the foregoing turbine sections, the platform includes a radially inward extending rim engaging a forward lip of the air seal.

In a further embodiment of any of the foregoing turbine sections, the air seal includes a forward wall with openings for exhausting air flow.

A vane assembly according to an exemplary embodiment of this disclosure, among other possible things includes a vane including an inner platform having a mount rail extending radially inwardly, an air seal attached to the inner platform of the vane section, the air seal includes a ring extending circumferentially about the axis including centering tabs receiving lugs disposed on the mount rail, and a ring nut received on the air seal and engaged to the mount rail for securing the air seal to the vane section.

In a further embodiment of the foregoing vane assembly, includes a full ring seal disposed between a surface of the inner platform and the ring nut.

In a further embodiment of any of the foregoing vane assemblies, the mount rail and the ring nut define a seal cavity and the full ring seal is disposed within the seal cavity.

In a further embodiment of any of the foregoing vane assemblies, includes a lock ring engaged to the air seal and the ring nut for securing a relative position between the ring nut and the air seal.

In a further embodiment of any of the foregoing vane assemblies, includes a wire seal disposed between the ring nut and a surface of the air seal.

In a further embodiment of any of the foregoing vane assemblies, the inner platform includes a radially inward extending rim engaging a forward lip of the air seal.

In a further embodiment of any of the foregoing vane assemblies, air seal includes a front wall with openings for exhausting cooling air flow.

A method of assembling a vane assembly according to an exemplary embodiment of this disclosure, among other possible things includes defining a plurality of vanes circumferentially about an axis that extend from an inner platform, abutting a front hub of the inner platform against a lip of an air seal, and loading the front hub against the lip of the air seal with a ring nut threaded onto the air seal.

In a further embodiment of the foregoing method, includes the step of engaging a plurality of tabs on a lock ring with the ring nut to hold a position of the ring nut relative to the air seal.

In a further embodiment of any of the foregoing methods, includes the sealing between the ring nut and a mount rail of the inner platform.

In a further embodiment of any of the foregoing methods, includes defining an cooling air chamber between the air seal and the inner platform and exhausting cooling air flow from openings within the air seal.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
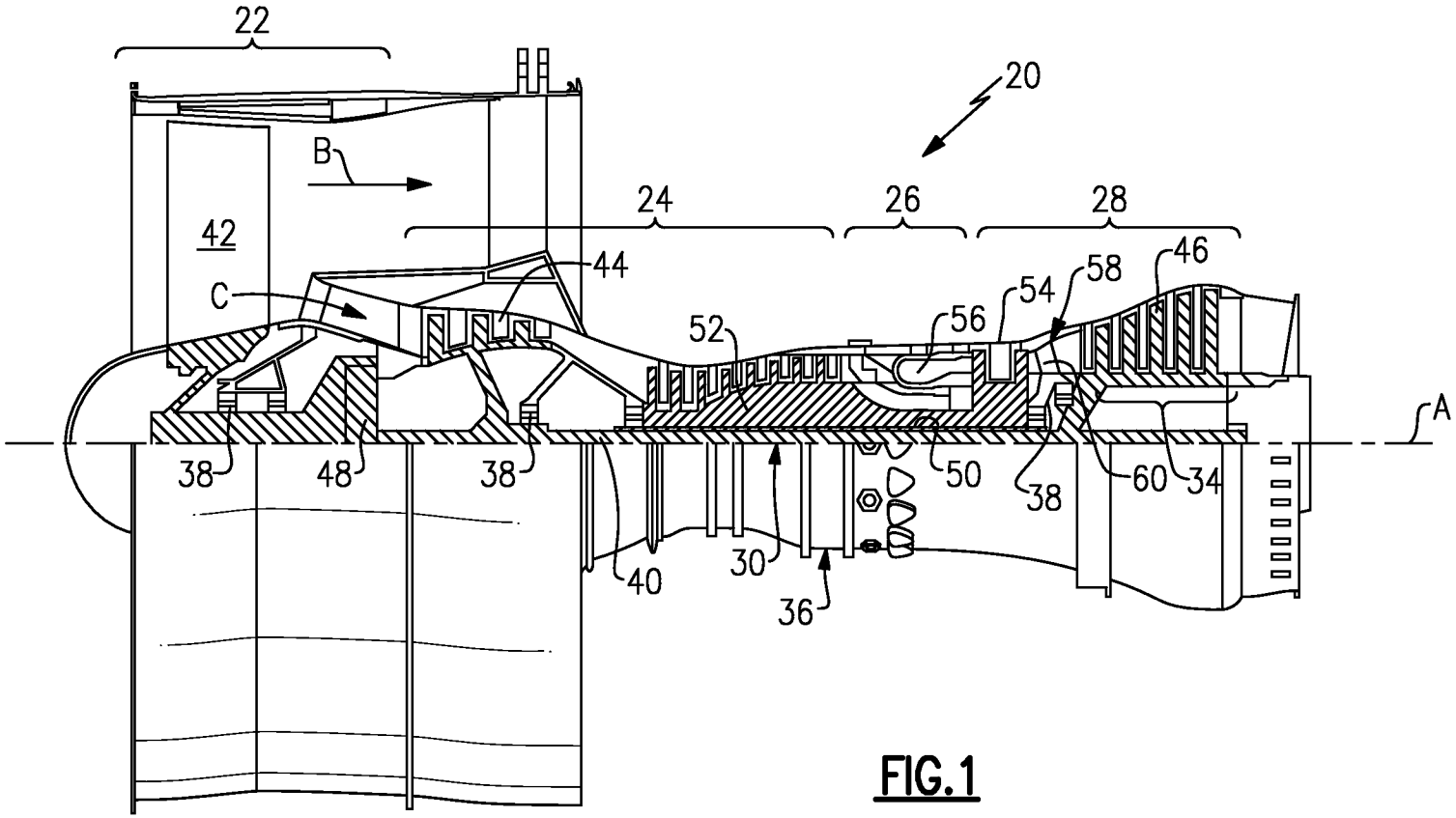
FIG. 1 is a schematic view of an example gas turbine engine.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or second) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or first) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram}\ ^\circ\text{R})/518.7)^{0.5}]$. The "Low corrected fan tip speed", as disclosed herein according to one non-limiting embodiment, is less than about 1150 ft/second.

The example gas turbine engine includes the fan 42 that comprises in one non-limiting embodiment less than about 26 fan blades. In another non-limiting embodiment, the fan section 22 includes less than about 20 fan blades. Moreover, in one disclosed embodiment the low pressure turbine 46 includes no more than about 6 turbine rotors schematically indicated at 34. In another non-limiting example embodiment the low pressure turbine 46 includes about 3 turbine rotors. A ratio between the number of fan blades 42 and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades 42 in the fan section 22 disclose an example gas turbine engine 20 with increased power transfer efficiency.

Figure 2:
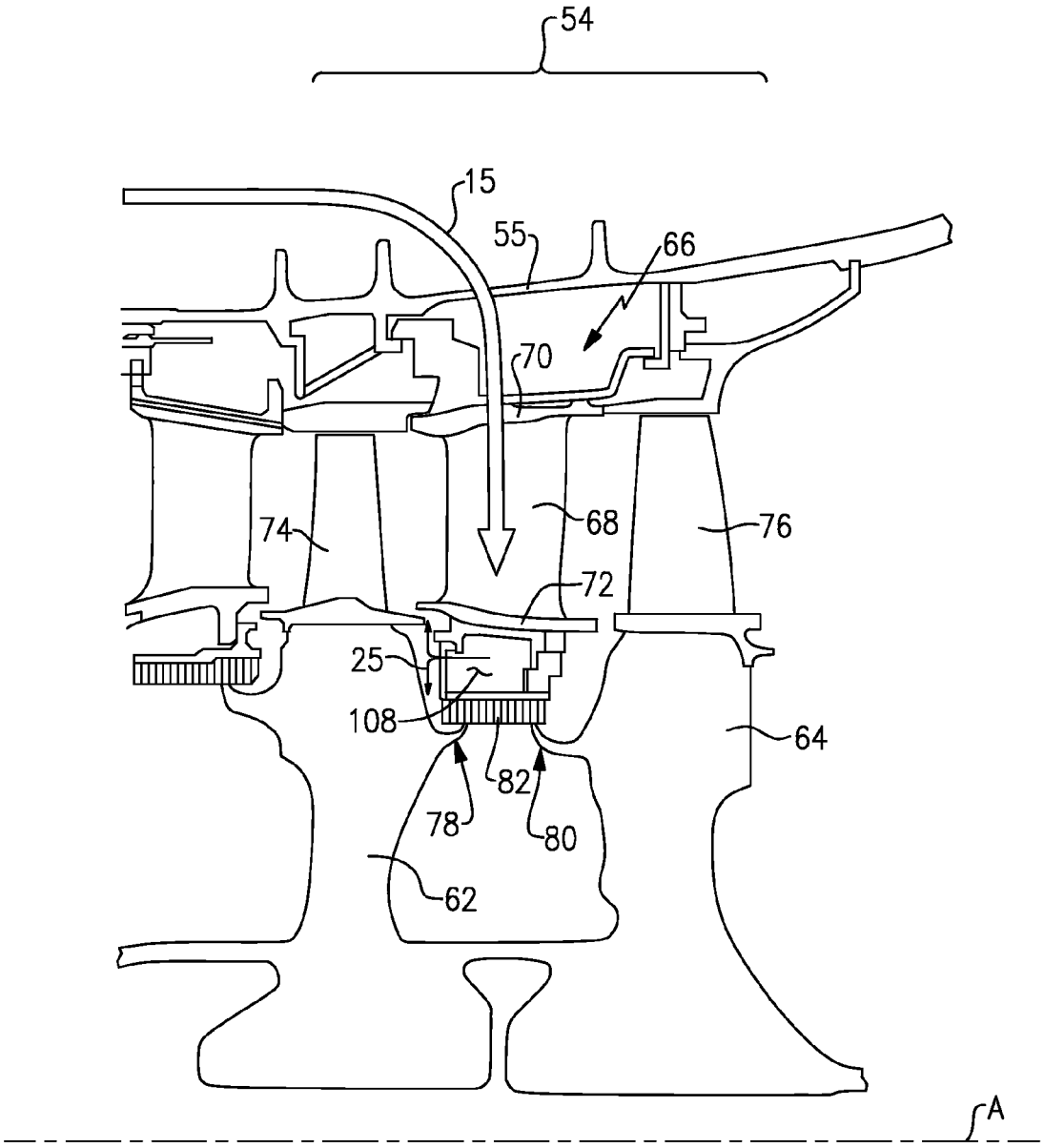
FIG. 2 is an enlarged cross-sectional view of a portion of the gas turbine engine.

Referring to FIG. 2 with continued reference to FIG. 1, the example the high pressure turbine 54 includes first and second rotors 62, 64, and corresponding first and second airfoils 74 and 76 that rotate with the first and second rotors 62, 64. Vane assembly 66 is disposed between rotors 62 and 64. The vane assembly 66 is fixed relative the rotation of the rotors 62 and 64 and includes vane 68 extending between an upper platform 70 and a lower platform 72. Leakage of hot gases through the turbine section 54 is undesirable and therefore features are provided to maintain gas flow between upper and lower platforms 70, 72.

Each of the airfoils 74 and 76 include upper and lower platforms and outer static shrouds that define the gas flow path. Each of the rotors 62, 64 include knife edge seals 78, and 80 that engage a honeycomb portion 82 that is fixed to the static vane assembly 66. The knife edges 78 correspond with the honeycomb 82 to seal and contain gas flow within the defined gas path through the high pressure turbine 54.

Cooling air indicated by arrows 25 is injected into a space between the fixed vane assembly 66 and the rotor 62. The cooling air in this space provides an increased pressure that aids in maintaining gas within the desired flowpath and preventing gas from flowing between the vanes and rotating airfoil 74, 76.

Cooling airflow is shown by the arrow 15 and flows from an outer portion of the turbine case 55 down through openings (not shown) through the vane 68 into a chamber 108 defined below the lower platform 72 of the vane assembly 66. The chamber 108 includes a plurality of openings 102 (FIG. 3) to allow cooling air 25 to flow forward into the gap between the rotor 62 and the fixed stator assembly 66.

Figure 3:
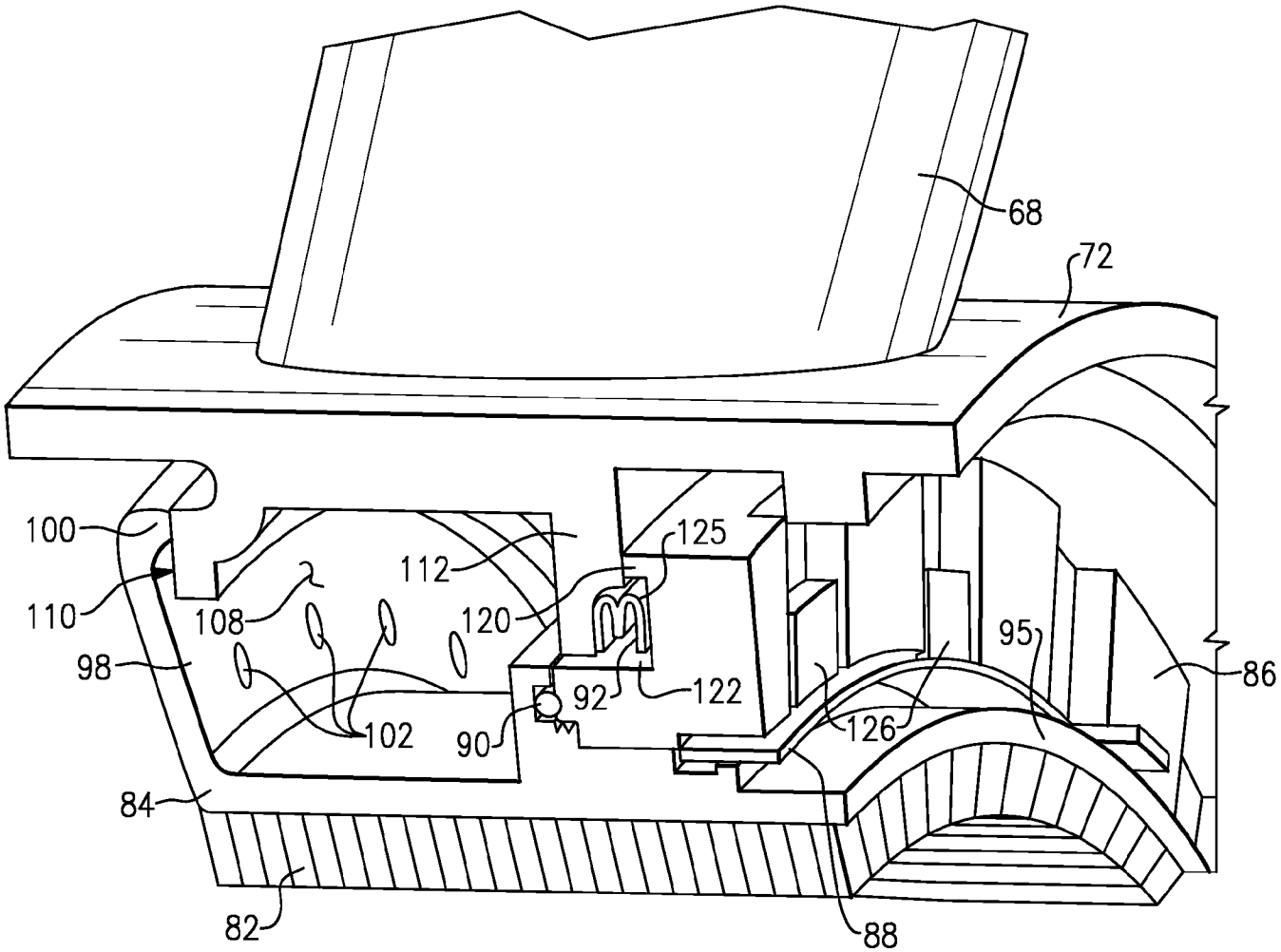
FIG. 3 is a sectional view of an example vane assembly.
Figure 5:
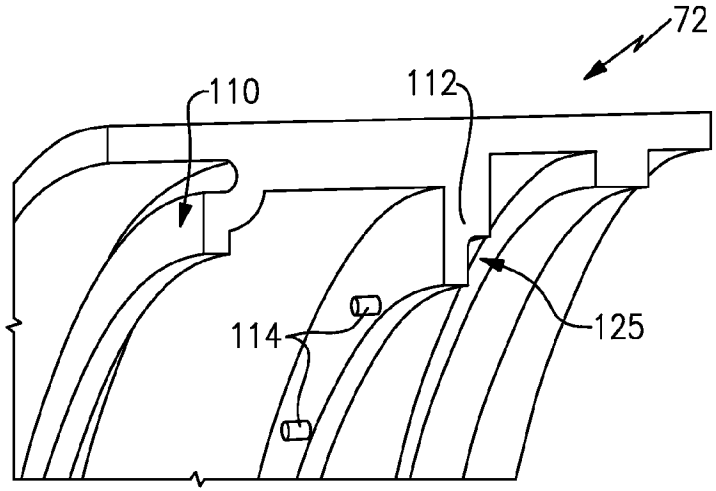
FIG. 5 is a cross-sectional view of an example lower platform.
Figure 7:
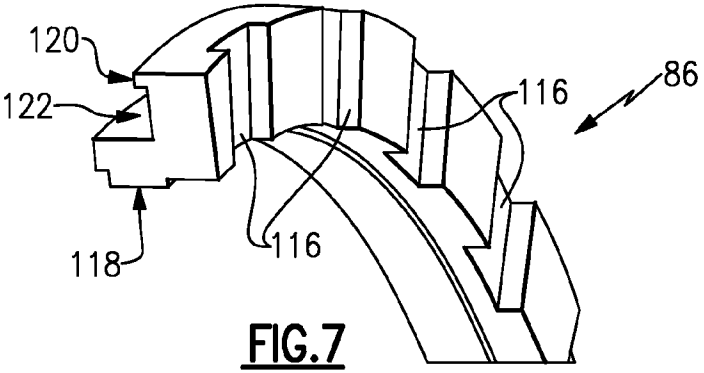
FIG. 7 is a perspective view of an example ring nut.

Referring to FIG. 3 with continued reference to FIG. 2, the example vane assembly 66 includes an integral one piece ring air seal 84 that receives cooling air that flows through the vanes 68 into the chamber 108. The air seal 84 is one continuous uninterrupted structure from a wall 98 to the aft most edge 95. The air seal 84 is attached to and mounted to the lower platform 72. The air seal 84 extends about the entire circumference of the lower platform 72 and about the axis A.

The example air seal 84 includes the forward wall 98 that defines a front lip 100 that engages a vane rim 110 that creates a forward seal for defining the cooling air chamber 108. The forward wall 98 includes a plurality of openings 102 that eject cooling air 25 into the forward gap between the rotor 62 and the vane assembly 66.

Figure 4:
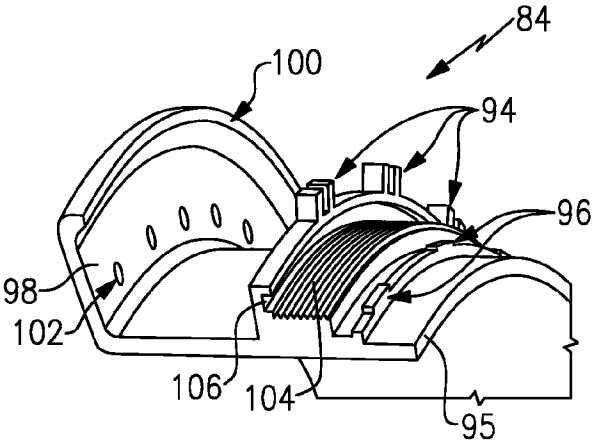
FIG. 4 is a sectional view of an example air seal.
Figure 6:
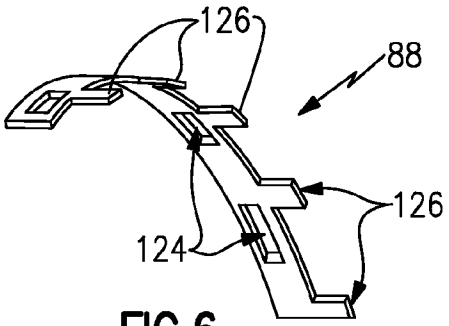
FIG. 6 is a perspective view of an example lock ring.
Figure 8:
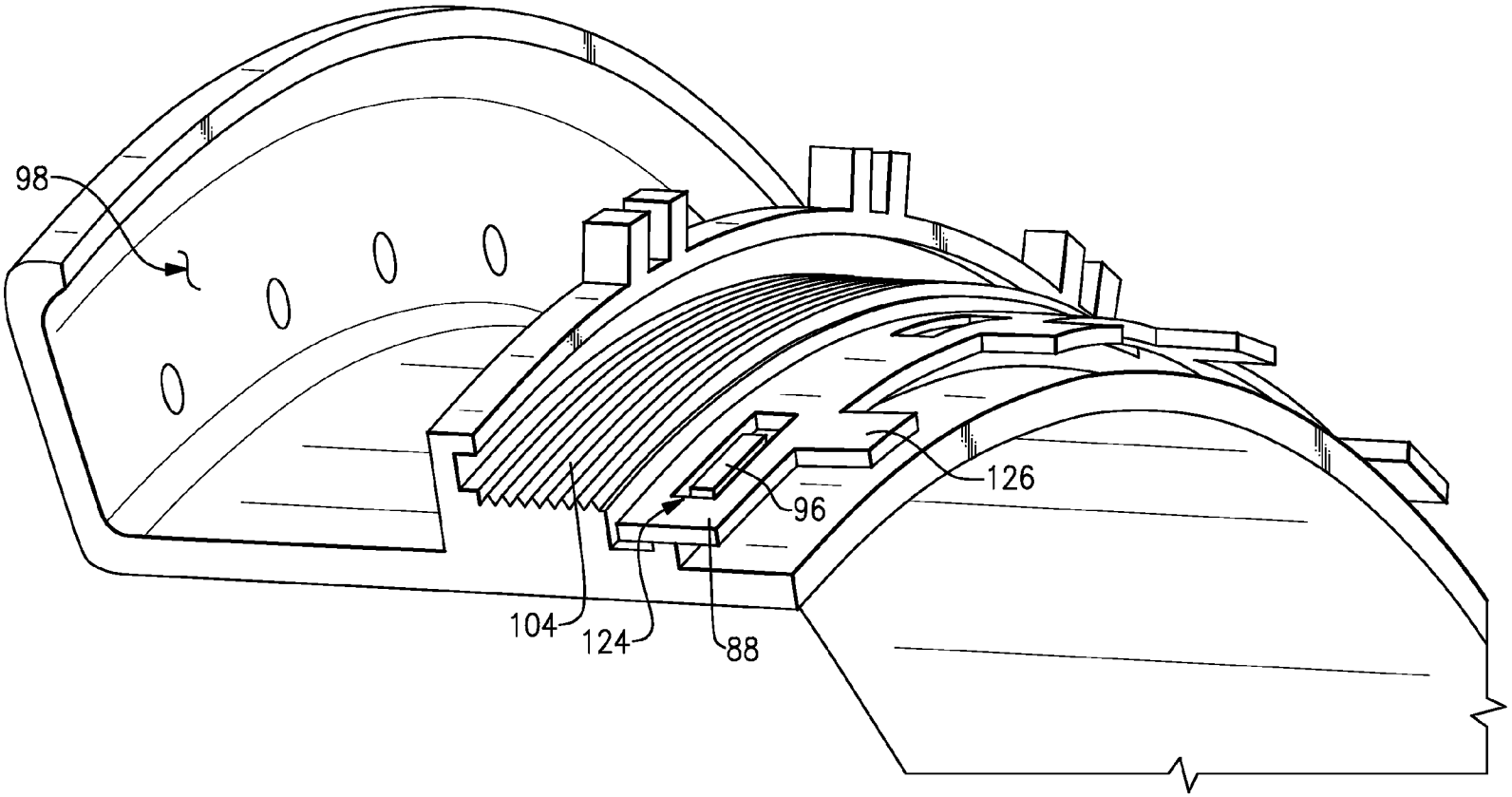
FIG. 8 is a schematic view of the example air seal including the lock ring.

A ring nut 86 engages threads 104 (FIG. 4) of the air seal 84 to hold the lower platform 72 of the vane assembly 66 between the front lip 100 and a shoulder 120 of the ring nut 86. The ring nut 86 includes a cavity 122 that corresponds with a slot or groove 125 disposed on the lower platform 72 to define an annular cavity for seal 92. In this example, the seal 92 comprises a W-shaped seal that biases outward against surfaces of the ring nut 86 and the lower platform 72.

The lower platform 72 includes the mount rail 112 that defines the annular groove 125 that corresponds with the cavity 122 defined in the ring nut 86. The seal 92 is an annular seal that extends about the circumference of the lower platform 72 to provide the desired seal. A second seal 90 is disposed within a groove 106 that is defined in the air seal 84 and a forward surface of the locking nut 86. In this example, the second seal 90 includes a circular cross-section such as an O-ring or wire seal that is compressed sufficiently to provide the desired sealing features. The combination of the first seal 92 and the second seal 90 provides for the containment of cooling air flow that flows into the cooling chamber 108 defined between the lower platform 72 and the air seal 84. The first seal 92 and the second seal 90 are fabricated from a seal material including properties compatible with the pressures and temperatures encountered in the high pressure turbine 54.

Referring to FIGS. 4, 5, 6, 7 and 8 with continued reference to FIG. 3, the example ring nut 86 includes slots 116 disposed at equally spaced intervals about the circumference of the locking nut 86. Locking ring segments 88 includes openings 124 that receive tabs 96 of the air seal 84 to fix the locking ring segments 88 relative to the air seal 84. The locking ring segments 88 includes tabs 126 that bend upward into the slots 116 once the locking nut 86 is tightened to a desired torque valve. The tabs 126 disposed within the slots 116 of the nut 86 prevent rotation of the nut 86 away from the desired locked position. The example locking nut 86 includes threads 118 that correspond with the threads 104 provided on the air seal 84.

The example lower platform 72 includes the forward vane rim 110 and the mounting rail 112. The mounting rail 112 is disposed approximately midway between a fore and aft edges of the lower platform 72. The example mounting rail 112 abuts the shoulder 120 of the locking ring 86 to bias the vane rim 110 into engagement with the front lip 100 of the air seal 84. The interface between the front lip 100 and the vane rim 110 provides the sealing required to contain cooling airflow in the chamber 108.

The air seal 84 includes a plurality of tabs 94 disposed about the circumference of the air seal 84. The example tabs 94 are evenly spaced, however, the tabs 94 cold be spaced in any manner about the air seal 84. A space between the tabs 94 receives lugs 114 on the mounting rail 112 of the lower platform 72. The lugs 114 received within the space between tabs 94 prevent rotation and maintain a relative circumferential position between the lower platform 72 and the example air seal 84. As appreciated, although only a few lugs 114 are illustrated, a plurality of lugs 114 are spaced at intervals about the circumference of the mounting rail 112 and are received between tabs 94 within the example air seal 84.

Figure 9:
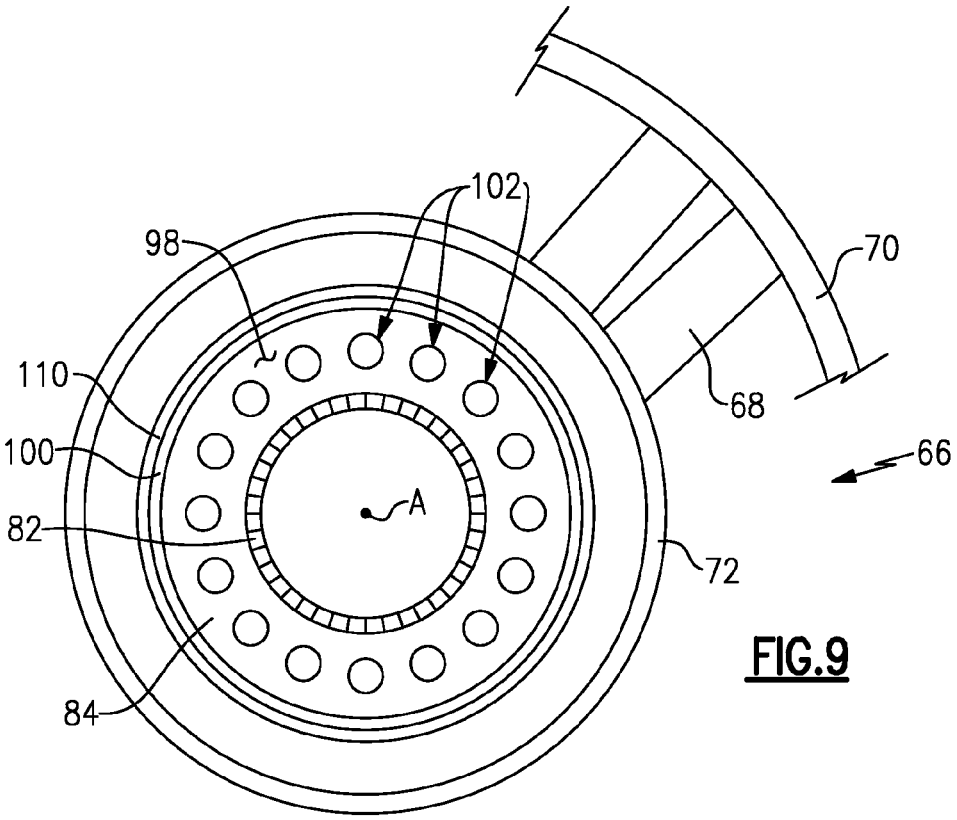
FIG. 9 is a front view of the example vane assembly.
Figure 10:
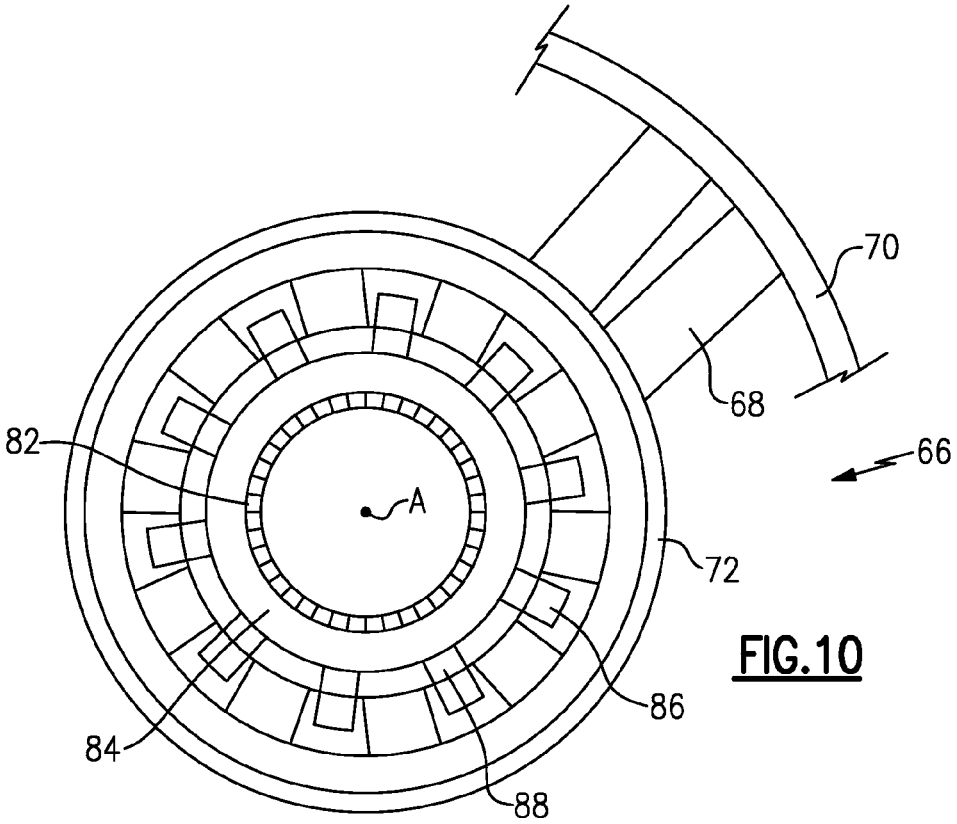
FIG. 10 is a rear view of the example vane assembly.

Referring to FIGS. 9 and 10 with continued reference to FIG. 3, the example vane assembly 66 includes a plurality of vanes 68 between the upper platform 70 and a lower platform 72. The lower platform 72 is mounted to the air seal 84 such that cooling airflow can be channeled through the various vanes 68 to the chamber 108 (FIG. 3) defined between the lower platform 72 and the air seal 84. The example air seal 84 is a continuous ring about the axis A and eliminates complications caused by multiple pieces or segmented structures.

Accordingly, the example air seal 84 provides a continual seal engagement with the lower platform 72 to provide the desired cooling passages and support the honeycomb structure 82 that engages seal knife edges 78, 80 on the rotors 62, 64. The single piece annular locking nut 86 is locked in place by a single, or multiple, segmented lock ring(s) 88 to provide the desired sealing function and connection to the lower platform 72.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A turbine section comprising:

first and second turbine rotors each carrying turbine blades for rotation about a central axis, said rotors each having at least one rotating seal at a radially inner location;

a vane assembly including a vane extending radially from a platform;

an air seal attached to the vane assembly, the air seal comprising a ring extending circumferentially about the axis; and a ring nut received on the air seal for securing the air seal to the vane assembly.

2. The turbine section as recited in claim 1, wherein the air seal includes mating features for circumferentially locating the air seal relative to the vane assembly.

3. The turbine section as recited in claim 1, including a full ring seal disposed between a surface of the vane platform and the ring nut.

4. The turbine section as recited in claim 1, including a lock ring engaged to the air seal and the ring nut for securing a relative position between the ring nut and the air seal.

5. The turbine section as recited in claim 1, including a wire seal disposed between the ring nut and a surface of the air seal.

6. The turbine section as recited in claim 1, wherein the platform includes a radially inward extending rim engaging a forward lip of the air seal.

7. The turbine section as recited in claim 6, wherein the air seal includes a forward wall with openings for exhausting air flow.

8. A vane assembly comprising:

a vane including an inner platform having a mount rail extending radially inwardly;

an air seal attached to the inner platform of the vane section, the air seal comprising a ring extending circumferentially about the axis including centering tabs receiving lugs disposed on the mount rail; and a ring nut received on the air seal and engaged to the mount rail for securing the air seal to the vane section.

9. The vane assembly as recited in claim 8, including a full ring seal disposed between a surface of the inner platform and the ring nut.

10. The vane assembly as recited in claim 9, wherein the mount rail and the ring nut define a seal cavity and the full ring seal is disposed within the seal cavity.

11. The vane assembly as recited in claim 8, including a lock ring engaged to the air seal and the ring nut for securing a relative position between the ring nut and the air seal.

12. The vane assembly as recited in claim 8, including a wire seal disposed between the ring nut and a surface of the air seal.

13. The vane assembly as recited in claim 12, wherein air seal includes a front wall with openings for exhausting cooling air flow.

14. The vane assembly as recited in claim 8, wherein the inner platform includes a radially inward extending rim engaging a forward lip of the air seal.

15. A method of assembling a vane assembly comprising:

defining a plurality of vanes circumferentially about an axis that extend from an inner platform;

abutting a front hub of the inner platform against a lip of an air seal; and loading the front hub against the lip of the air seal with a ring nut threaded onto the air seal.

16. The method as recited in claim 15, including the step of engaging a plurality of tabs on a lock ring with the ring nut to hold a position of the ring nut relative to the air seal.

17. The method as recited in claim 15, including sealing between the ring nut and a mount rail of the inner platform.

18. The method as recited in claim 15, including defining a cooling air chamber between the air seal and the inner platform and exhausting cooling air flow from openings within the air seal.

* * * * *